United States Patent [19]

Salyer

[11] Patent Number: 4,549,733

[45] Date of Patent: Oct. 29, 1985

[54] WEIGHT TYPE EXERCISING DEVICE

[76] Inventor: Alan Salyer, 1092 Louise, Ypsilanti, Mich. 48197

[21] Appl. No.: 464,092

[22] Filed: Feb. 4, 1983

[51] Int. Cl.[4] ..... A63B 21/06

[52] U.S. Cl. ..... 272/118; 272/134; 272/144; 272/93

[58] Field of Search ..... 272/118, 117, 134, 143, 272/93

[56] References Cited

U.S. PATENT DOCUMENTS

| | | | |
|---|---|---|---|
| 3,112,108 | 11/1963 | Hanke | 272/117 X |
| 3,438,627 | 4/1969 | LaLanne | 272/118 |
| 4,402,504 | 9/1983 | Christian | 272/118 |

*Primary Examiner*—Richard J. Apley
*Assistant Examiner*—William R. Browne
*Attorney, Agent, or Firm*—Stephenson and Boller

[57] ABSTRACT

A cable exercise machine has the capability for allowing a user to perform various exercises by the lifting and lowering of weights by means of a cable. The cable is tethered at opposite ends on the frame of the machine and it passes through a sheave assembly and a sheave block assembly. The user pulls on the sheave block assembly to lift the weights. The sheave assembly is adjustably positionable on the frame of the machine to different positions and is operatively related with the cable and the sheave block assembly such that the sheave block assembly hangs free from the sheave assembly substantially the same amount for all adjustment positions of the sheave block assembly on the frame so that the user can remain in the same position relative to the machine for all adjustment positions of the sheave assembly. Additional exercise stations are provided, a seat and bench station, and a leg exercise station. These have adjustment capabilities and may be used in conjunction with the cable-operated weights.

16 Claims, 8 Drawing Figures

WEIGHT TYPE EXERCISING DEVICE

BACKGROUND AND SUMMARY OF THE INVENTION

This invention relates to a cable exercise machine in which the user can perform various exercises which involve lifting and lowering of weights by means of a cable.

There are many types of exercise machines which comprise weights operated by the user through a system of pulleys and cables. Examples of prior cable exercise machines are shown by the following U.S. Pat. Nos. 374,496; 1,253,885; 2,977,120; 3,438,627; 3,647,209 and 4,199,139. There are certain advantages to using cable exercise machines. In particular, they allow a single stack of weights to be utilized for different purposes depending upon the particular mode of operation of the exercise machine chosen by the user, and they enable the user to perform a variety of different types of exercises more conveniently than with other types of weights. Accordingly, it is known in the art to construct cable exercise machines with various adjustment capabilities to perform different exercising functions as well as to accommodate different sizes of individuals. Hence, adjustable pulleys, adjustable brackets and adjustable slides have been heretofore used in cable exercise machines.

One type of exercise which can be performed on a cable exercising machine involves the user pulling on a hand grip affixed to the cable to lift the weights. In prior machines the point on the machine from which the user pulls the cable is adjustable in accordance with the particular type of exercise being performed. However, when this point is repositioned for a different exercise, it is necessary that the user reposition himself as well in relation to the machine unless he wants to make a further adjustment of the machine other than simply adjusting the pull point. Hence, with prior machines of this type, a greater amount of floor space is required or additional adjustments needed if the full range of pull exercises is to be made use of.

The present invention is directed to a new and improved cable exercise machine which enables the user to perform a variety of exercises within the confines of a limited space. In other words, the cable exercise machine of the present invention possesses a capability in its arrangement and construction whereby the pull point may be adjusted to accommodate a particular exercise and/or a particular individual without the need to have the individual reposition himself with respect to the machine or to perform any other adjustment.

More specifically, in the preferred embodiment of the invention as disclosed herein, the individual may perform pulling type exercises by means of a hand grip operatively related with the cable by means of a sheave assembly wherein the sheave assembly may be adjusted to different operational positions on the machine but without the need for the user to reposition himself in relation to the machine or to make any other adjustment.

The ends of the cable are tethered on the machine, and the sheave assembly is operable on the cable along a segment intermediate the tethered ends. By adjusting the sheave assembly on the machine framework, the segment of the cable along which the sheave assembly is operable is adjusted.

A further attribute of the invention is that it comprises a multi-station capability within a compact overall layout which allows the user to perform a variety of exercises including both arm and leg exercises and these can be done with the user in various positions, either standing, seated or reclined.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
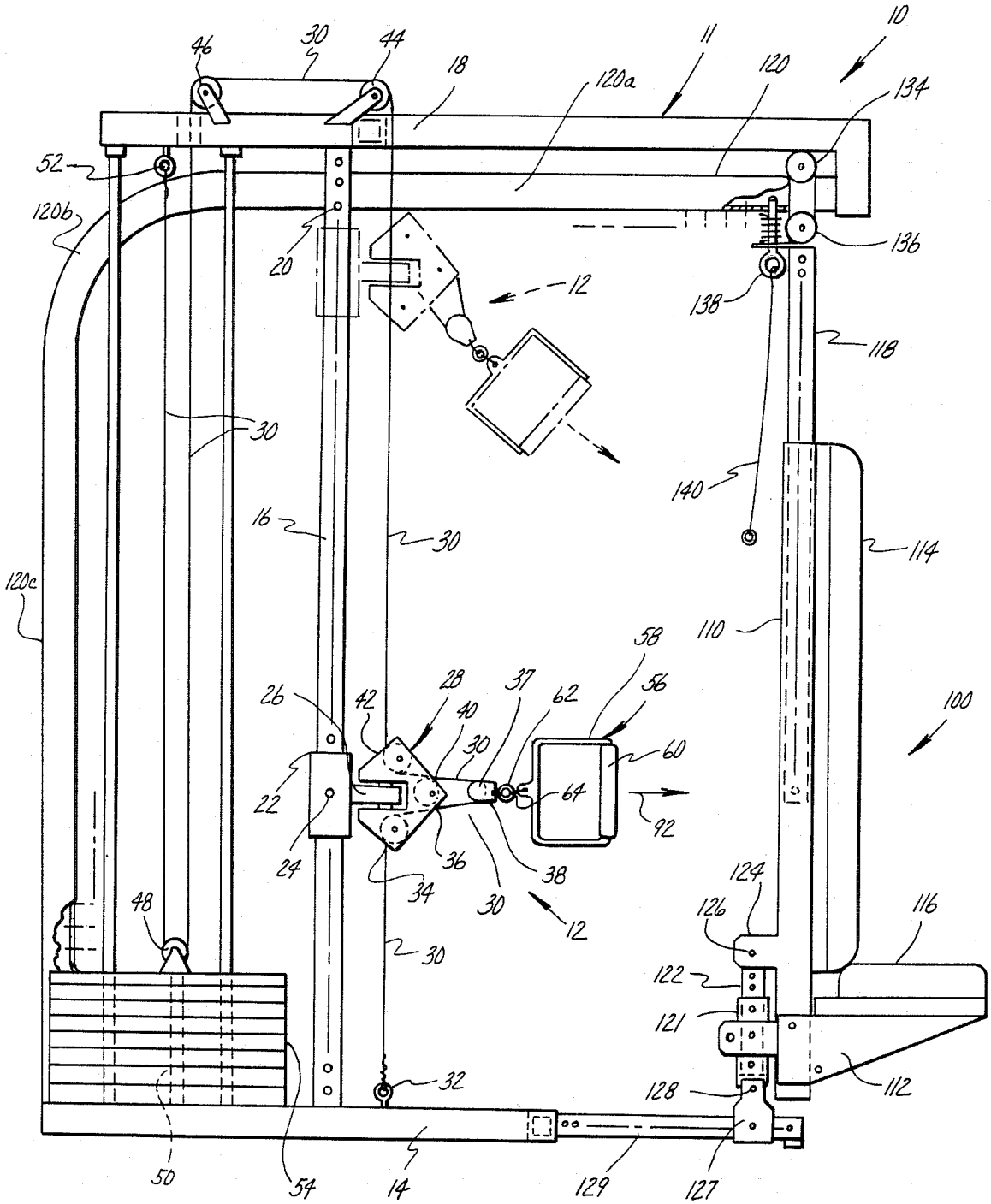
FIG. 1 is a side elevational view illustrating a portion of the cable exercise apparatus of the invention.

FIG. 1 illustrates a portion of the preferred embodiment of cable exercise machine 10 of the present invention. The machine comprises a framework 11 composed of various metal tubes having square cross sections. These include horizontal and vertical members suitably secured together. The framework may be free-standing or anchored as required in accordance with conventional techniques either to floor and/or wall and/or ceiling.

FIG. 1 illustrates a pull exercise portion 12. The portion of framework 11 associated with the pull exercise portion 12 comprises a horizontal base member 14, a vertical upright member 16, and a horizontal top member 18.

The upright member 16 includes a series of vertically spaced apart holes 20. A carrier bracket 22 which telescopes onto the upright is adjustably positionable along the upright's length to a desired adjustment position. When the desired adjustment is secured, a pin 24 is passed through aligned apertures in the bracket and holes 20 of the upright. A bearing carrier 26 is affixed to bracket 22 and projects forwardly of upright 16.

A sheave assembly 28 is pivotally mounted on bearing carrier 26 for pivotal motion about a generally vertical axis. A cable 30 is operatively associated with sheave assembly 28 as follows. One end of the cable is tethered, for example on base 14 by means of an eye bolt 32. From this point of tether the cable extends vertically to enter the sheave assembly at 34. It continues by exiting the sheave assembly at 36. From there it loops 180° around the sheave 37 of a sheave block assembly 38 and returns to re-enter the sheave assembly 28 at 40. It exits the sheave assembly at 42 vertically upwardly to a guide sheave 44. The cable is redirected by guide sheave 44 to a more rearwardly guide sheave 46 which in turn guides the cable downwardly to the top of a selector tube 50. The cable loops 180° around a sheave 48 on the top of the selector tube and heads upwardly where it is tethered by means of an eye bolt 52 on the frame member 18. The selector tube 50 passes through a stack of weights 54 and an appropriate number of weights are fastened to the selector tube in accordance with the exercise requirements involved.

Also associated with the sheave block assembly 38 is an exercise handle 56 comprising a U-shaped frame 58 and a hand grip 60. The frame 58 connects at its midpoint with sheave block assembly 38 by means of an eyelet 62 which is swivelly mounted on the sheave block assembly. The connection is by a snap hook 64 which allows the exercise handle to be readily disconnected from the eyelet so that ready attachment of different devices to the sheave block assembly can be made depending upon the particular exercise requirements involved.

Figure 2:
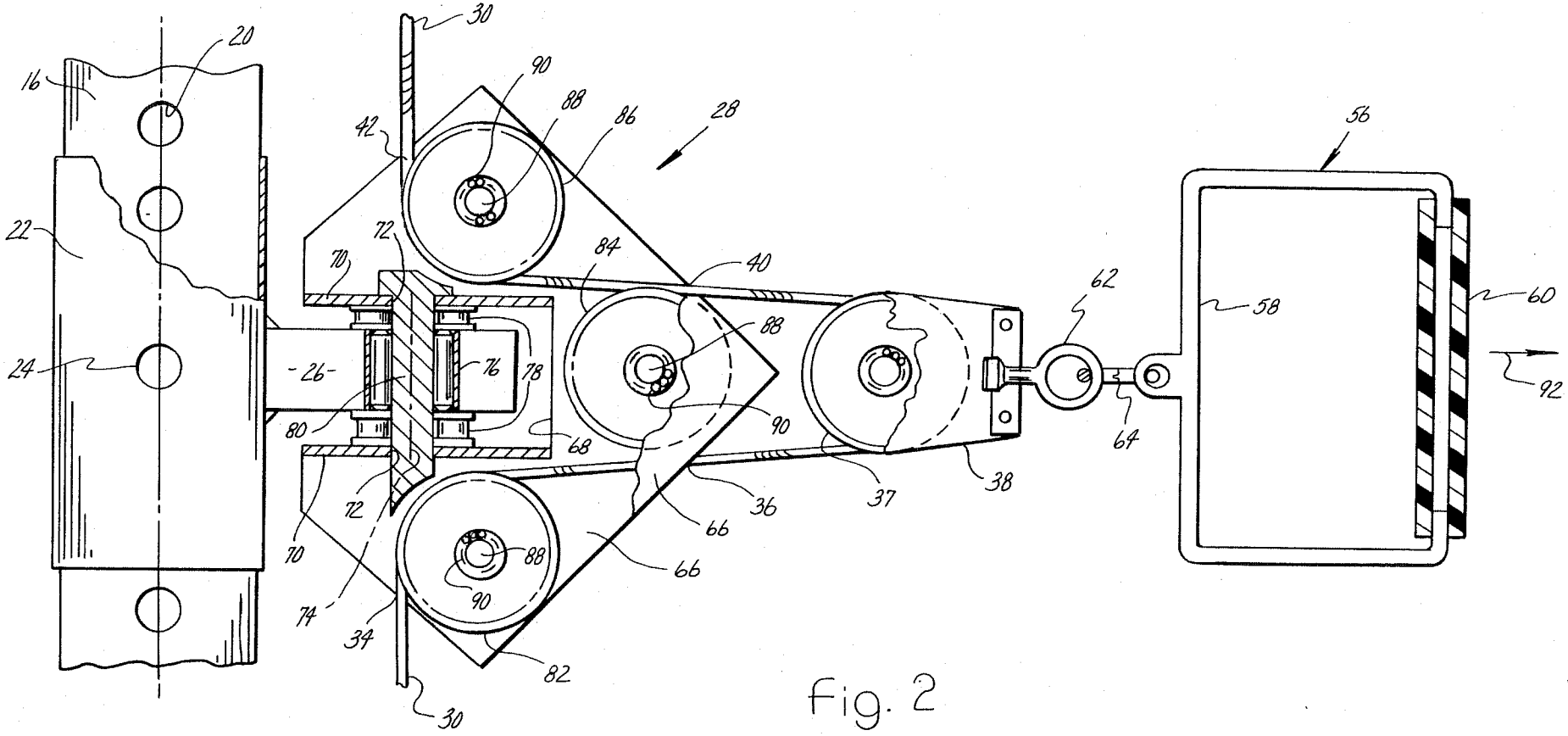
FIG. 2 is an enlarged side elevational view having portions broken away of one part of the apparatus of FIG. 1.

Greater detail of sheave assembly 28 can be seen in FIG. 2. The sheave assembly comprises a bracket composed of laterally spaced apart side plates 66 which are provided with throats 68. The two side plates 66 are joined together at their throats by means of horizontal bearing flange, or bridging plates 70 which are vertically spaced apart. The side plates and the bearing flange plates are suitably secured together by any suitable means such as welding.

Aligned circular apertures 72 are provided in bearing flange plates 70 and to define a vertical axis 74 passing through them. The holes align with a roller bearing assembly 76 provided in the bearing carrier bracket 26. Thrust bearing assemblies 78 are provided between carrier bracket 26 and the respective bearing flange plates 70. A vertical axle 80 passes through as shown so that in this way the sheave assembly 28 is pivoted about axis 74.

The sheave assembly also comprises three sheaves 82, 84, 86. These are disposed laterally between the two side plates 66, and each is journaled for rotation thereon through suitable shafts and bearings 88, 90. The cable 30 is guided on the respective sheaves 82, 84, 86 in the manner shown in FIG. 2 for the pull extended horizontally forwardly of the sheave assembly.

For purposes of explaining operation, let it be assumed that the hand grip is displaced horizontally forwardly in the direction of arrow 92. This will in turn pull the sheave block assembly 38 horizontally forwardly. Because of the fixed tether of cable 30 at eyelet 32 there is no motion of the cable through the sheave assembly between points 34 and 36. Instead, the forward motion of the pull is taken up by relative motion of the cable through the sheave assembly between the points 42 and 40. This in turn results in the stack of weights being vertically elevated.

During the extension motion the cable is guided by the pulleys 84 and 86 as it passes through the sheave assembly 28. These are low friction mountings so that the frictional resistence is minimized thereby promoting a smoother action of the cable with the mechanism and eliminates damage to the cable which might be caused due to relative movement of the cable over a fixed surface. When the pull is released, the force of the weights is effective to return the pull horizontally back toward the sheave assembly.

A particular advantage of the invention can be appreciated when vertical adjustment of the sheave assembly on upright 16 is considered. This is done by unpinning the slide 22 from the upright, repositioning it to any desired new position along the upright, and then repinning it to the upright. For example, the broken line position of FIG. 1 illustrates the sheave assembly at an elevated position from the solid line position of that Figure. With the weights at rest and the slide 22 unpinned from the upright, displacement of the slide and sheave assembly will result in the cable passing through the sheave assembly such that the length of the lower vertical portion of the cable from eyelet 32 to the sheave assembly will increase or decrease in a corresponding amount to the decrease or increase in the length of the upper vertical portion of the cable between sheave 44 and the sheave assembly 28. The cable will also pass through the sheave block assembly 38 during vertical adjustment. Hence, regardless of the vertical adjustment position of the sheave assembly on the upright, the amount of the free length of the pull from the sheave assembly 38 will remain constant. In other words, unlike prior cable exercise machines it is not necessary for the user to adjust his position relative to the machine as the vertical position of the sheave assembly is repositioned on the upright. Moreover, there is a certain freedom provided by the arrangement which allows the pull to be operated in other than a strictly horizontal direction. For example, as can be seen at the top of FIG. 1 the pull can be operated in a downwardly and forwardly direction to elevate the weights, and when it is in a lower position (not shown) it can be pulled forwardly and upwardly to elevate the weights. This is accompanied by a further degree of freedom about the vertical axis 72 which allows the assembly 28 to be angularly positioned about axis 72 in any vertical adjustment position. Hence, when these two degrees of freedom are combined, the exercise machine possesses a range of operational capabilities encompassing a range of different exercising techniques as well as accommodating individuals of varying physical statures.

Because of the particular arrangement of the three sheaves of the sheave assembly, the segments of cable 30 on opposite sides of sheave 84 will never simultaneously contact the sheave. Hence, any rotation which is imparted to that sheave by one segment will not be effective to rub against the opposite segment.

Figure 3:
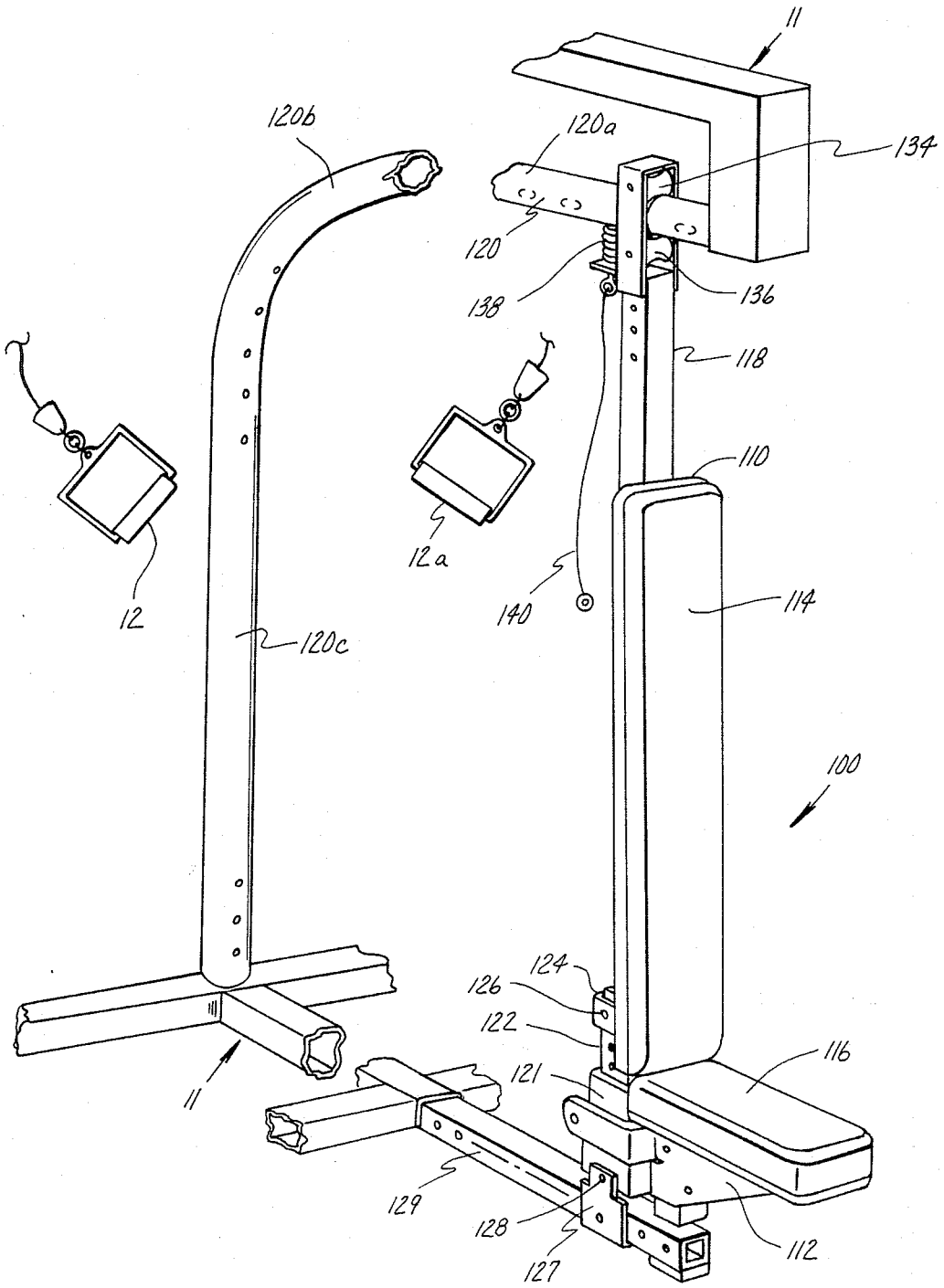
FIG. 3 is a perspective view of FIG. 1.

Considering both FIGS. 1 and 3 one can see that the pull assembly 12 is disposed laterally of the exercise machine to one side of a bench and seat mechanism 100. The preferred embodiment comprises, in addition to the pull assembly 12, a second pull assembly 12*a* substantially identical to pull assembly 12 but on the opposite lateral side of the bench and seat machanism 100. Hence, the user can occupy the space rearwardly of the bench and seat mechanism and operate both pull assemblies simultaneously.

The bench and seat mechanism provides an alternate convenience for the user in use of the pulls 12 and 12*a*. In other words instead of standing behind the bench and seat the user can occupy the bench and/or the seat and use the pull assemblies simultaneously. The bench and seat, however, may be used if desired with other than the pulls.

The bench and seat mechanism comprises a bench support member 110 and a seat support member 112. The bench cushion 114 is suitably secured to the bench support member 110 and the seat cushion 116 to the seat support member 112. Briefly the bench and seat support members are adjustably positionable on the framework in order to accommodate the particular exercise involved and/or the particular size of the individual using the equipment. The adjustment possibilities include both vertical and horizontal adjustment as well as an inclining adjustment. The seat is also removable.

FIGS. 1 and 3 illustrate the bench in a generally upright orientation. For this orientation the bench is vertically adjustable with respect to the frame of the exercise machine in the following manner. The bench support 110 telescopically engages a square tube 118 which is suspended vertically from a rail 120 mounted on the machine's framework. The lower end of the bench support member 112 is also supported by a telescopic engagement from the base. This telescopic engagement from the base comprises an outer telescopic member 121 on the base and an inner telescopic member 122 on the bench support. The upper end of the inner member 122 is disposed laterally between brackets 124 projecting rearwardly on either side of the bench support member 110. A pin 126 extends through suitable apertures in the brackets 124 and in the member 122. The outer member 121 is supported from the base by means of a bracket 127 on a horizontal square tube 129. The two members 121 and 127 may be pinned together as at 128. Aligned holes are similarly provided in member 118 and in the bench support member 110 and suitable pins are passed through the aligned apertures in these two to lock them in place. Vertical adjustment is accomplished by removing the lock pins and sliding the bench either upwardly or downwardly and then repinning it at top and bottom.

The seat support is securely affixed to the bench support so as to be at generally a right angle to the bench. It however may be removed if desired.

The square tube 129 on which the outer member 120 is supported has a series of holes. Bracket 127 may be positioned along the length of this member and/or the member may be positioned along the floor so as to perform fore and aft adjustment of the point of support of the bench and seat mechanism on the floor. As the bench and seat mechanism is adjusted fore and aft, the upper end of member 118 rolls along track 120. For this purpose vertically spaced rollers 134, 136 are provided on the upper end of member 118 to engage the track 120 from opposite sides. A spring-loaded lock pin 138 is mounted on member 118 and must be released from locking engagement with a series of apertures extending along the length of the track for enabling the member 118 to roll along the track. Release of the spring-loaded lock pin is facilitated through use of a pull cord 140. When the desired adjustment position has been reached, the lock pin can snap back into locking engagement with the rail, or track.

Track 120 comprises a horizontal segment **120*a* extending from the front toward the rear. It merges into a curved 90° segment 120*b* which finally extends into a vertical downward segment 120*c* to base 14**.

By appropriate adjustment of the various adjustment means, the rollers may be rolled from the horizontal section **120*a* of the track around the curved bend 120*b* and down the vertical portion 120*c*** to bring the bench to a horizontal orientation. In this position the bench may be used in a manner analogous to a conventional weight lifting bench either in conjunction with or independently of the pull mechanisms. It is also possible for the bench and seat to be brought to a position where the bench is neither horizontal nor vertical but rather is inclined at some inclination in between the horizonal and vertical. This is done through appropriate adjustment of the various adjustment means.

FIGS. 4 through 7 illustrate the remainder of the cable exercise machine. This portion is shown in use in FIG. 4 in association with the second pull assembly **12*a***, but with the hand grip and handle removed.

Figure 4:
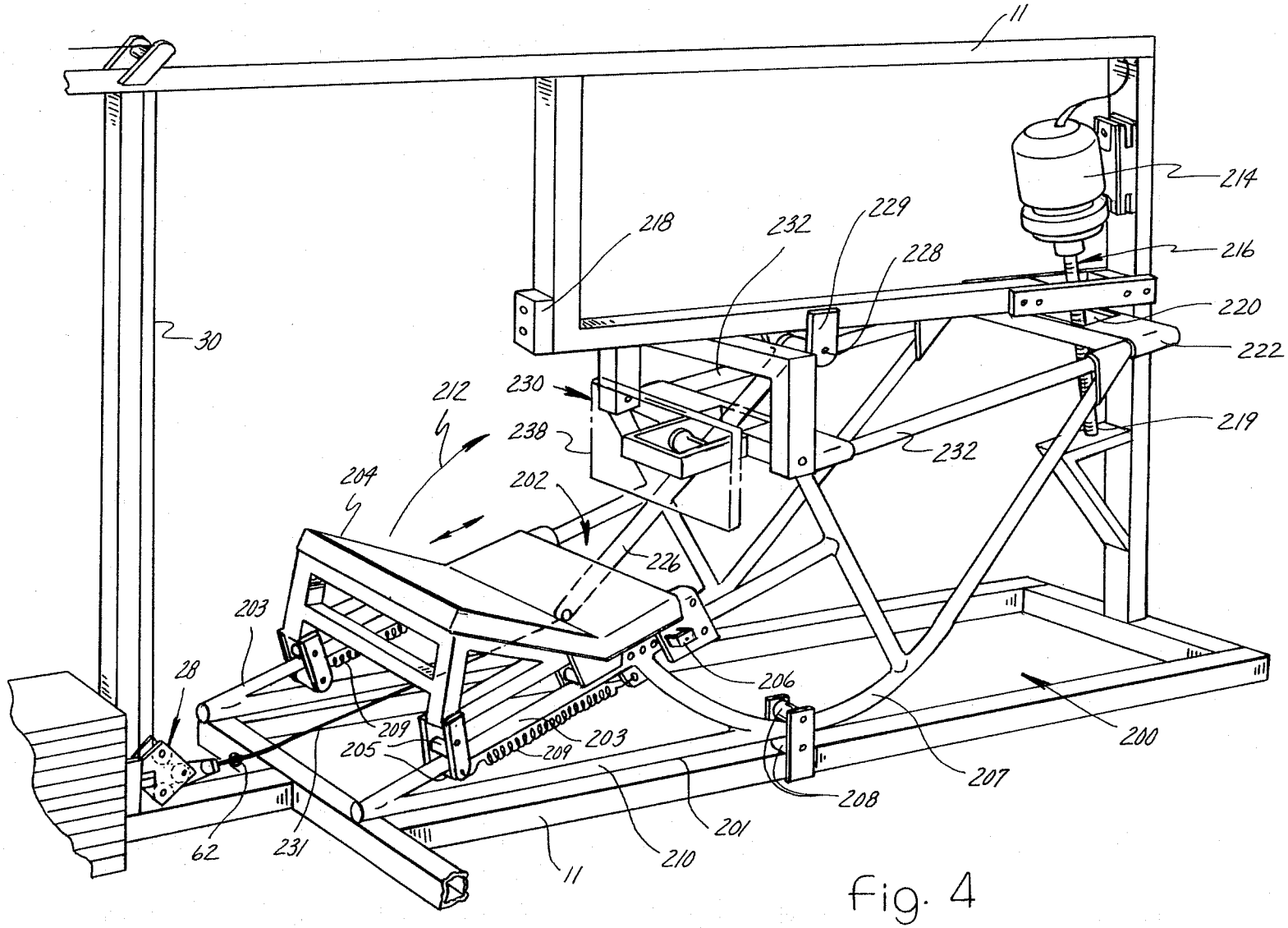
FIG. 4 is a perspective view illustrating a further portion of the cable exercise apparatus.
Figure 5:
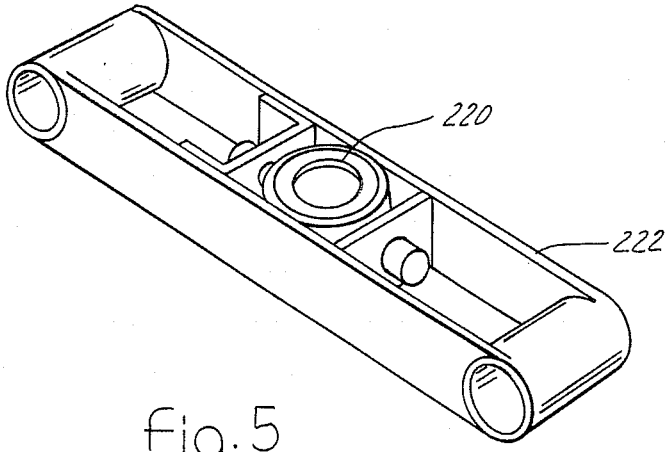
FIG. 5 is a perspective view of one portion of FIG. 4 shown by itself.
Figure 6:
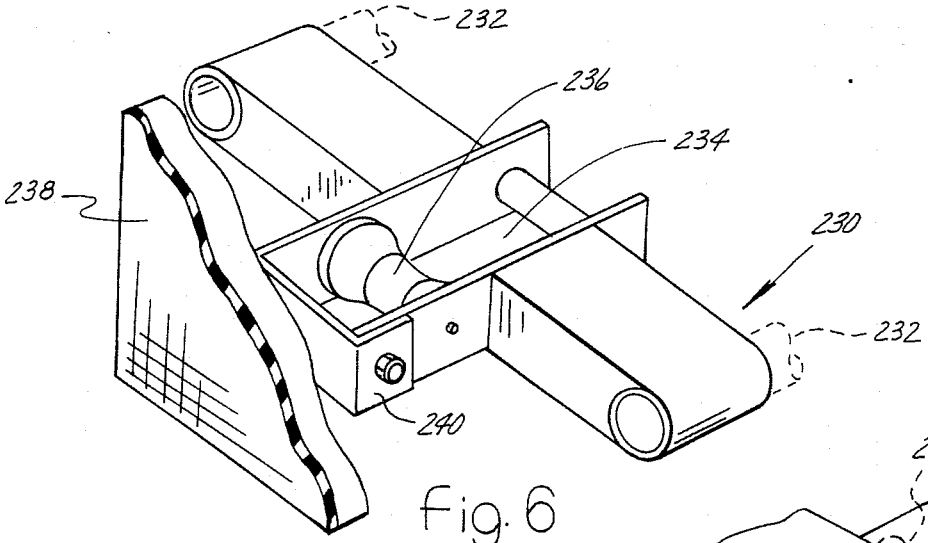
FIG. 6 is a fragmentary perspective view illustrating another portion of FIG. 4 by itself.

Referring to FIG. 4 this remaining portion of the machine is intended for use in performing leg exercises. It comprises a rocker assembly 200 having its own frame 201 on the machine framework 11. The rocker frame includes an inclined track portion 202 formed by tubes 203 on which a seat and back assembly 204 is adjustably supported. The seat and back is positioned to a desired position of adjustment along tubes 203 and is locked in place.

As the seat and back is moved downwardly and to the left as viewed in FIG. 4, it stretches helical springs 209 on opposite sides. Hence, the springs 209 are effective to urge the seat and back assembly forwardly when it is unlocked on the frame.

Figure 7:
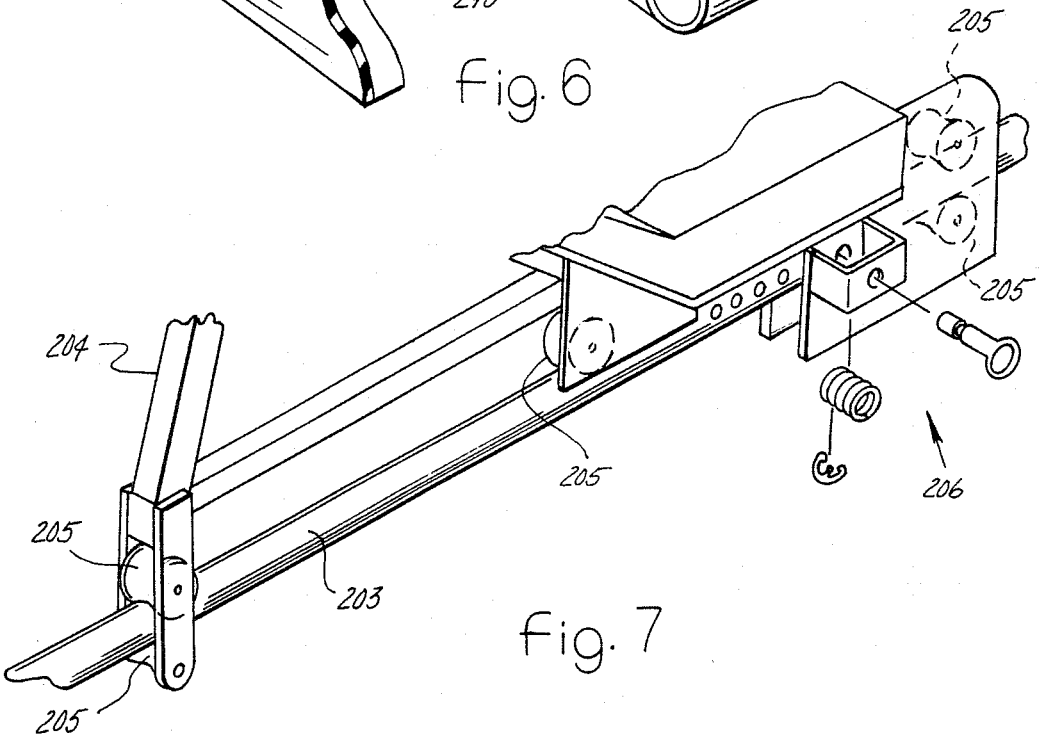
FIG. 7 is a fragmentary view having portions broken away illustrating still another portion of FIG. 4 by itself.

FIG. 7 illustrates details of the mounting including rollers 205 via which the seat and back assembly 204 is mounted for adjustable rolling movement along tubes 203. It also shows the locking pin arrangement 206 which is used to lock the assembly 204 in a desired adjustment position. The lower sides of the rocker frame 201 are centrally contoured in an arc 207 and these arcs are captured by sets of rollers 208. FIG. 4 illustrates the maximum reclined position in which straight segments 210 of the lower sides of the rocker frame are disposed horizontal. The entire frame may be rocked from this position in the general direction indicated by the arrow 212 to any desired position.

The adjustment of the rocker frame is accomplished by means of an electric motor drive 214 which operates a screw and nut mechanism 216 to perform the adjustment. The screw is affixed to the output shaft of a suitable reducer and coupling on the drive. The screw and nut mechanism is disposed laterally centrally of the rocker, and the motor is controlled by push buttons 218 which are conveniently accessible to an occupant of the seat to turn the screw 219 either forwardly or in reverse. The nut 220 is supported on the forward end of the rocker frame and details can be seen in FIG. 5 by itself. The nut 220 is centrally mounted in a bridge 222 which spans the two sides of the rocker frame at the front. As the screw operates the nut runs either up or down the screw depending on the direction of screw rotation. This imparts rocking motion to the rocker assembly on the machine frame to perform the desired adjustment.

A weight actuator beam 226 is pivoted centrally on frame 11 at 228 by means of a pivot bracket 229. The distal end of the beam is connected by a cable 231 to the swivel eyelet 62 from which the pull handle has been disconnected. The beam is operatively associated with a foot plate assembly 230 which can slide fore and aft along rails 232 of the rocker frame. An aperture 234 is provided in the foot plate assembly through which beam 226 passes and the beam bears against a roller 236 which spans the aperture. The footplate 238 faces the seat and attaches onto the assembly by a pivot bracket 240.

With the user seated in the seat and his feet placed on the foot plate 238, the foot plate may be pushed forwardly to slide the assembly along the rails 232. This in turn by the interaction of roller 236 on beam 226 imparts a force to the beam 226 reacted by the weights connected to the cable. Hence, the leg exercise is performed by pushing the footplate forwardly and then releasing it to correspondingly pivot beam 226 about 228 and operate the weights via the cable and pull mechanism.

Figure 8:
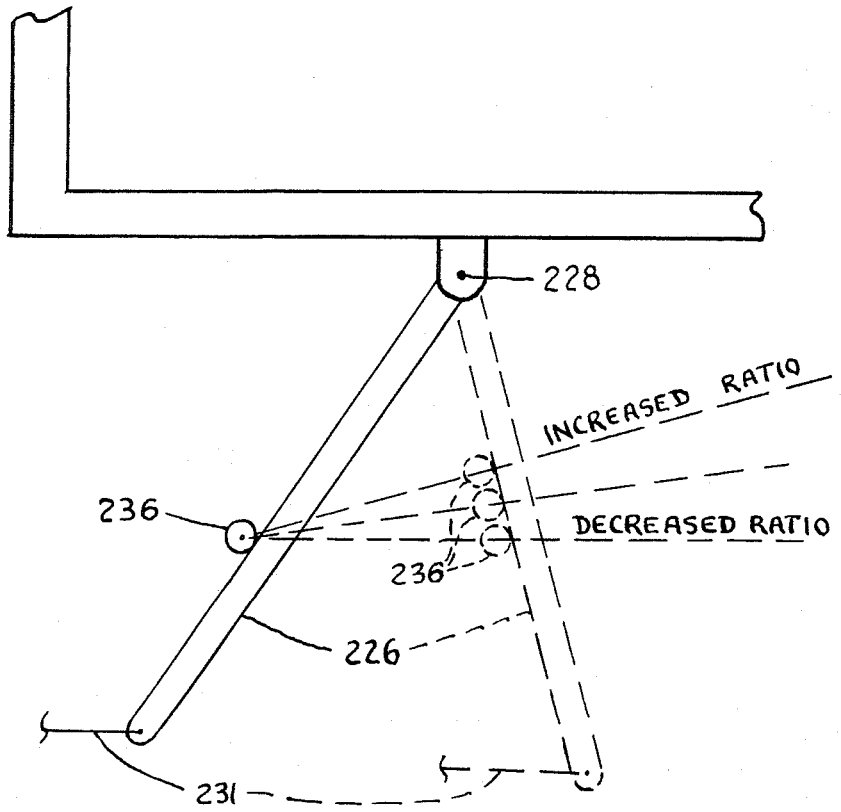
FIG. 8 is a fragmentary side elevational view of a diagramatic nature useful in explaining the principles of one aspect of the present invention.

The leg press arrangement at its lowest setting (the opposite of that shown in FIG. 4) provides a roughly equal resistance from the beginning to the end of the stroke. As the ball-nut assembly 222 "climbs" the screw, the inclination of the rocker frame increases in the direction the foot plate assembly 230 travels. (The seat and guiderails relationship remains constant). Regardless of how the ball-nut is adjusted on the screw (i.e. regardless of the inclination of the rocker-frame assembly) the resistance at the beginning of a leg press is approximately the same because roller 236 and the upper rocker pivot points share the same axis. For increased inclinations of the rocker-frame assembly, the guiderails force the foot plate assembly to increasingly "climb" the weight actuator beam 226 as it progresses through the stroke. This imparts a varying resistance that increases progressively through the length of the stroke. The higher the nut is on the screw (the greater the rocker-frame inclination), the greater is the varying resistance and the greater is the rate of change of this increasing resistance through the stroke's length. This principle is illustrated schematically in FIG. 8.

With the cable exercise machine of the present invention, a user can perform a wide variety of different exercise functions using the various portions of the machine. Moreover, the machine can be used in limited spaces such as in an apartment or a home. Its various adjustment capabilities enable the machine to be readily adapted to particular requirements of various individuals.

While a preferred embodiment has been disclosed, it will be appreciated that principles of the invention are applicable to other embodiments.

What is claimed is:

1. In a cable exercise machine in which a user exercises against a load resistance through a cable and a system of sheaves on the machine frame, the improvement which comprises the cable being tethered on the frame of the machine at spaced apart points on the cable, a sheave assembly means adjustably positionable on the frame and comprising sheaves, a sheave block assembly means via which the user exerts force against the load resistance and comprising a sheave, said sheave assembly means and said sheave block assembly means being operatively related with the cable between its points of tethering such that the cable enters the sheave assembly means at a first location, exits the sheave assembly means at a second location to loop around the sheave of the sheave block assembly means and re-enter the sheave assembly means at a third location and exit the sheave assembly means at a fourth location, said sheave assembly means having its sheaves operatively relating the cable with the frame such that the amount of extension of the sheave block assembly means from the sheave assembly means at which the load resistance is first encountered by a user exerting a pull on the sheave block assembly means is always substantially the same for all adjustment positions of the sheave assembly means on the frame, including a leg exercise station operatively related with the sheave block assembly means, said leg exercise station comprising its own frame, a seat on the frame of the exercise station, an actuator beam pivotally mounted on the frame of the exercise station, a footplate assembly means on the frame of the exercise station operatively related with said actuator beam and poised for engagement by the feet of a user seated on said seat, means operatively relating said actuator beam, said sheave block assembly means, and said footplate assembly means such that the footplate assembly means is displaceable by the feet of a seated user along a line of action to impart pivotal motion to said actuator beam and said actuator beam is in turn effective to operate the load resistance via the sheave block assembly means.

2. The improvement set forth in claim 1 in which the leg exercise station frame is adjustable in a rocking fashion on the frame of the cable exercise machine.

3. The improvement set forth in claim 2 in which the frame of the machine comprises rollers, the leg exercise elements station frame comprises curved elements captured by the rollers on the frame of the machine, and including a screw and nut adjusting means between the two frames effective to run the curved elements of the leg exercise frame through the rollers and thereby adjust the inclination of the leg exercise station frame on the machine frame.

4. The improvement set forth in claim 3 in which the screw and nut is operable by an electric motor drive and including controls disposed for use by a seated occupant to operate the screw and nut means to adjust the inclination of the leg exercise station frame while seated.

5. The improvement set forth in claim 2 in which the foot plate assembly means comprises a bridge spanning a portion of the leg exercise station frame, aperture in said bridge through which the actuator beam passes, a roller spanning said aperture and operatively engaged by the actuator beam, a footplate mounted on said bridge, said bridge being guided for straight line motion along a portion of the leg exercise station frame such that when the footplate is operated on by the user, the bridge slides lengthwise along the last mentioned frame with the roller imparting pivotal motion to the actuator beam while rolling lengthwise along the actuator beam.

6. In a cable exercise machine in which a user exercises against a load resistance through a cable and a system of sheaves on the machine frame, the improvement which comprises the cable being tethered on the frame of the machine at spaced apart points on the cable, a sheave assembly means adjustably positionable on the frame and comprising sheaves, a sheave block assembly means via which the user exerts force against the load resistance and comprising a sheave, said sheave assembly means and said sheave block assembly means being operatively related with the cable between its points of tethering such that the cable enters the sheave assembly means at a first location, exits the sheave assembly means at a second location to loop around the sheave of the sheave block assembly means and re-enter the sheave assembly means at a third location and exit the sheave assembly means at a fourth location, said sheave assembly means having its sheaves operatively relating the cable with the frame such that the amount of extension of the sheave block assembly means from the sheave assembly means at which the load resistance is first encountered by a user exerting a pull on the sheave block assembly means is always substantially the same for all adjustment positions of the sheave assembly means on the frame, including a bench and seat means on the machine frame with one end of said seat and bench means being roller-mounted on a track, the track having horizontal and vertical segments joined together by a curved bend segment so that the bench and seat means may be adjusted by rolling it along the track between a vertical position and a horizontal position, said bench and seat means being operatively related on the machine frame so that a user occupying the bench and seat means can operate the machine at different adjustment positions of the bench and seat means on the machine frame.

7. In a weight exercise machine having a frame the improvement which comprises, a track on the frame, a seat and bench means mounted on the frame of the machine with one end of said seat and bench means being roller-mounted on said track, the track having horizontal and vertical track segments joined together by a curved bend track segment so that the bench and seat means may be adjusted by rolling the bench and seat means may be adjusted by rolling it along the horizontal track segment, the curved bend track segment, and the vertical track segment to adjust the seat and bench means from a vertical upright position to a horizontal reclined position.

8. In a cable exercise machine in which the user exercises against a load resistance through a cable and a system of sheaves on the machine frame the improvement which comprises rollers on the frame, a leg exercise station having its own frame mounted on the machine frame, said leg exercise station frame comprising a seat on the leg exercise station frame, a foot plate mechanism on said leg exercise frame and means operatively coupling said footplate mechanism with the cable and load resistance so that the foot plate mechanism can be operated by the user to exercise against the load resistance and in which the leg exercise station frame comprises curved elements captured by the rollers on the frame of the machine and an adjusting means between the two frames effective to run the curved elements of the leg exercise frame through the rollers and thereby adjust the inclination of the frame of the leg exercise station on the machine frame and to adjust the coupling ratio between the footplate mechanism and the load resistance so as to thereby provide a variable resistance.

9. The improvement set forth in claim 8 in which said adjusting means is a screw and nut operable by an electric motor with the nut being mounted on the leg exercise station frame at a location spaced forwardly of the curved elements.

10. In a cable exercise machine in which the user exercises against a load resistance through a cable and a system of sheaves on the machine frame the improvement which comprises a leg exercise station having its own frame mounted on the machine frame, said leg exercise station frame comprising a seat, a foot plate mechanism on said leg exercise frame and means operatively coupling said footplate mechanism with the cable and load resistance so that the foot plate mechanism can be operated by a user to exercise against the load resistance, and in which the footplate mechanism comprises a bridge spanning a portion of the frame of the leg exercise station, an aperture in said bridge through which an actuator beam passes, said actuator beam being pivotally mounted on the frame of the machine, a roller means for spanning said aperture and operatively engaging the actuator beam, a footplate mounted on said bridge, said bridge being guided for straight line motion along a portion of the leg exercise station frame such that when the footplate is operated by the user, the bridge slides lengthwise along the last-mentioned frame with the roller means imparting pivotal motion to the actuator beam while rolling lengthwise along the actuator beam, the actuator beam being operatively coupled with the cable and system of sheaves on the machine frame at a location spaced from its pivotal mounting on the machine frame.

11. In a cable exercise machine in which the user exercises against a load resistance through a cable and a system of sheaves on the machine frame the improvement which comprises a leg exercise station having its own frame mounted on the machine frame, said leg exercise station frame comprising a seat, a foot plate mechanism on said leg exercise frame and means operatively coupling said footplate mechanism with the cable and load resistance so that the foot plate mechanism can be operated by a user against the load resistance, and including means between the machine frame and the leg exercise station frame for adjustably positioning the leg exercise station frame on the machine frame such that the coupling ratio between the footplate mechanism and the load resistance is caused to be adjusted so as to thereby provide a variable resistance.

12. In a cable exercise machine in which a user exercises against a load resistance through a cable and a system of sheaves on a machine frame, the improvement which comprises the cable being tethered on the machine frame at spaced apart points on the cable, a sheave assembly means which is adjustably positionable on the frame along a particular direction, said cable having two segments extending from the sheave assembly means to a pull, and two other segments of the cable extending from said sheave assembly means along the direction of adjustment of the sheave assembly means on the frame, said sheave assembly means comprising a pair of sheaves journaled thereon for rotation about axes which are spaced apart along the direction of adjustment of the sheave assembly means on the frame and each serving to direct the cable from a corresponding one of its two other segments to a corresponding one of its first two mentioned segments and a third sheave journaled for rotation on the sheave assembly means about an axis which is spaced toward the pull from an imaginary line passing through the axes of rotation of said pair of sheaves, said third sheave having an operative relationship relative to said pair of sheaves for respective one-at-a-time selective engagement with said first two mentioned cable segments such that when the pull is operated in a direction perpendicular to the direction of adjustment of the sheave assembly means on the frame and any direction over a range on either side thereof which includes a component of motion parallel to the direction of adjustment of the sheave assembly means on the frame, at most only one of said first mentioned cable segments, and not the other, engages the third sheave, and the third sheave, in the process, also serves to prevent the cable from coming out of contact with said pair of sheaves.

13. The improvement set forth in claim 12 further including a sheave block assembly attached to said pull, said sheave block assembly comprising a sheave, said cable comprising a further segment extending between its first two mentioned segments and looped around the sheave of said sheave block assembly.

14. In a cable exercise machine in which a user exercises against a load resistance through a cable and a system of sheaves on a machine, the improvement which comprises a pull means which is used to act against the load resistance, a sheave assembly means which comprises sheave means for receiving the cable, said sheave assembly means is adjustably positionable on the frame along a particular direction, said cable having two segments extending from the sheave assembly means to said pull means, and two other segments of said cable extending from said sheave assembly means along the direction of adjustment of the sheave assembly means on the frame, said sheave means comprising a pair of sheaves journaled on the sheave assembly means for rotation about axes which are spaced apart along the direction of adjustment of the sheave assembly means on the frame and each serving to direct the cable from a corresponding one of its two other segments to a corresponding one of its first two mentioned segments and further sheave means journaled for rotation on the sheave assembly means and spaced toward said pull means from an imaginary line passing through the axes of rotation of said pair of sheaves, said further sheave means having an operative relationship relative to said pair of sheaves for selective engagement with said first two mentioned cable segments such that when said pull means is pulled in a direction perpendicular to the direction of adjustment of the sheave assembly means on the frame and any direction over a range of either side thereof which includes a component of motion parallel to the direction of adjustment of the sheave assembly means on the frame, said first mentioned cable segments selectively engage said further sheave means in a manner correlated with the sense of a component of motion of said pull means parallel to the direction of adjustment of said sheave assembly means on said frame, and said further sheave means, in the process, also serves to prevent the cable from coming out of contact with said pair of sheaves.

15. In a cable exercise machine in which a user exercises against a load resistance through a cable and a system of sheaves on the machine frame, the improvement which comprises the cable being tethered on the frame of the machine at spaced apart points on the cable, a sheave assembly means adjustably positionable on the frame and comprising sheaves, a pull via which the user imparts force to operate the load resistance, said sheave assembly means and said pull being operatively related with the cable between its points of tethering such that the cable enters the sheave assembly means at a first location, exits the sheave assembly means at a second location to operatively couple with the pull and re-enter the sheave assembly means at a third location, and exit the sheave assembly means at a fourth location, said sheave assembly means being arranged and constructed and operatively related with the cable such that the amount of extension of the pull from the sheave assembly means at which the load resistance begins to be encountered is always substantially the same for all adjustment positions of the sheave assembly means on the frame, one of said points of tethering being at the segment of the cable which exits said fourth location, and when the pull is pulled there is no cable travel through the sheave assembly means between the pull and said one point of tethering.

16. In a cable exercise machine in which the user exercises against a load resistance through a cable and a system of sheaves on the machine frame the improvement which comprises a leg exercise station having its own frame mounted on the machine frame, said leg exercise station frame comprising a seat, a foot plate mechanism on said leg exercise frame and means operatively coupling said footplate mechanism with the cable and load resistance so that the foot plate mechanism can be operated by a user to exercise against the load resistance, and in which the footplate mechanism comprises a bridge spanning a portion of the frame of the leg exercise station, an actuator beam which extends past said bridge, said actuator beam being pivotally mounted on the frame of the machine, a roller means for operatively engaging the actuator beam where the actuator beam extends past the bridge, a footplate mounted on said bridge, said bridge being guided for straight line motion along a portion of the leg exercise station frame such that when the footplate is operated by the user, the bridge slides lengthwise along the frame with the roller means imparting pivotal motion to the actuator beam while rolling lengthwise along the actuator beam, the actuator beam being operatively coupled with the cable and system of sheaves on the machine frame at a location spaced from its pivotal mounting on the machine frame.

* * * * *